US006211761B1

(12) United States Patent
Yoshino et al.

(10) Patent No.: US 6,211,761 B1
(45) **Date of Patent: *Apr. 3, 2001**

(54) ELECTROMAGNETIC RELAY, JOINING STRUCTURE FOR HINGE SPRING AND YOKE IN THE ELECTROMAGNETIC RELAY, AND FLUX PENETRATION PREVENTING STRUCTURE

(75) Inventors: Kosei Yoshino, Kita-Saku-gun; Takahiro Nakabayashi, Saku; Masaki Takahata, Komoro, all of (JP)

(73) Assignee: Takamisawa Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/039,386

(22) Filed: Mar. 16, 1998

(30) Foreign Application Priority Data

Sep. 10, 1997 (JP) ..... 9-261143
Sep. 30, 1997 (JP) ..... 9-281164

(51) Int. Cl.[7] ..... H01F 5/00; H01F 7/08
(52) U.S. Cl. ..... 335/282; 335/281
(58) Field of Search ..... 335/78–86, 255, 335/281, 282, 299; 336/196, 198

(56) References Cited

U.S. PATENT DOCUMENTS

| | | | | |
|---|---|---|---|---|
| 3,660,791 | * | 5/1972 | Davis | 336/192 |
| 4,326,696 | * | 4/1982 | Ishikawa et al. | 251/129 |
| 4,639,704 | * | 1/1987 | Shand et al. | 335/255 |
| 5,041,870 | * | 8/1991 | Imai et al. | 335/83 |

FOREIGN PATENT DOCUMENTS

| | | |
|---|---|---|
| 298242 | 6/1917 | (DE) . |
| 19 19 729A | 11/1970 | (DE) . |
| 3002029 | 7/1981 | (DE) . |
| 4145608 | 5/1992 | (JP) . |
| 9-330641 | 12/1997 | (JP) . |

* cited by examiner

*Primary Examiner*—Michael L. Gellner
*Assistant Examiner*—Raymond Barrera
(74) *Attorney, Agent, or Firm*—Arent Fox Kintner Plotkin & Kahn PLLC

(57) ABSTRACT

An electromagnetic relay has an iron core, an armature, a coil wound around the iron core, a yoke, a hinge spring, and a joining structure. The yoke is fastened rigidly to the iron core and has an engaging hole and a fitting portion. The hinge spring is used to support the armature rotatably on the yoke, and the joining structure is used to join the hinge spring to the yoke in the electromagnetic relay. The hinge spring has a tongue and a dish-shaped portion, and the yoke has an engaging hole and a fitting portion for engaging with the tongue and the dish-shaped portion. The hinge spring is joined to the yoke by inserting and fitting the hinge spring into the yoke. This structure serves to simplify the process of assembling the hinge spring to the yoke and drastically reduce the number of assembling steps required. Further, in a flux penetration preventing structure of the electromagnetic relay, a coil bobbin is formed, integral with or separate from a base block, and a venting portion, for allowing air trapped in a center hole in the coil bobbin to be vented therethrough, is formed in an upper flange of the coil bobbin. Therefore, sealing work of the base block of the electromagnetic relay can be performed smoothly and pinhole-free sealing thereof can be provided.

4 Claims, 8 Drawing Sheets

ELECTROMAGNETIC RELAY, JOINING STRUCTURE FOR HINGE SPRING AND YOKE IN THE ELECTROMAGNETIC RELAY, AND FLUX PENETRATION PREVENTING STRUCTURE

BACKGROUND OF THE INVENTION

1. Field of the Invention

The present invention relates to an electromagnetic relay, a joining structure for a hinge spring and a yoke in the electromagnetic relay, and a flux penetration preventing structure, and more particularly, to a joining structure for joining a hinge spring to a yoke in the electromagnetic relay, and a terminal side sealing structure for an anti-flux type electromagnetic relay mounted on a printed circuit board.

2. Description of the Related Art

In the construction of an electromagnetic relay, for example, a coil is wound around an iron core to construct an electromagnet, and a yoke as a component to complete a magnetic circuit with it is fastened rigidly to the iron core and an armature is rotatably mounted in such a manner as to bridge between the yoke and the head of the iron core of the electromagnet to construct an electromagnet structure. Then, one end of this electromagnet structure is fixed to the yoke and the other end thereof is made to engage with the armature, the rotatable movement of the armature being supported by a plate-like hinge spring formed from a resilient member.

Incidentally, assembling the hinge spring to the yoke in the electromagnetic relay requires assembling equipment (such as a crimping tool or a welder). This has presented the problem in that the assembling requires many assembling steps and takes a lot of time.

Further, in the prior art, when mounting the electromagnetic relay on a printed circuit board, the printed circuit board is passed through a high-temperature solder bath, for example, and the electromagnetic relay with solder applied to the terminal leads thereof is mounted rigidly on the printed circuit board. At this time, there is a possibility that flux may rise from the solder bath and penetrate into the interior of the electromagnetic relay; to prevent this, the bottom of the electromagnetic relay (base block) is sealed.

In constructing an electromagnetic relay having such a flux penetration preventing structure, a liquid sealant is filled into the base of the base block and the liquid sealant is then heated to form the sealing structure. This, however, has entailed the problem that, when the liquid sealant cures after heating, bubbles are trapped in the sealing structure, forming pinholes and defeating the purpose of the sealing.

The prior art electromagnetic relay and problems associated with the prior art will be described in detail later with reference to drawings.

SUMMARY OF THE INVENTION

An object of the present invention is to provide a simple part-to-part joining structure that allows the hinge spring to be assembled to the yoke in an electromagnetic relay without requiring specific assembling equipment, and thereby simplify the assembly process and drastically reduce the number of assembling steps required. It is another object of the present invention to enhance work efficiency by smoothly performing sealing work and providing pinhole-free sealing to the bottom sealing portion of the base block of the electromagnetic relay.

According to the present invention, there is provided a joining structure for joining a hinge spring to a yoke in an electromagnetic relay, wherein the hinge spring includes a tongue and a dish-shaped portion; the yoke includes an engaging hole and a fitting portion for engaging with the tongue and the dish-shaped portion, and the hinge spring is joined to the yoke by inserting and fitting the hinge spring into the yoke.

Further, according to the present invention, there is provided an electromagnetic relay comprising an iron core; an armature; a coil wound around the iron core; a yoke, fastened rigidly to the iron core, having an engaging hole and a fitting portion; a hinge spring for supporting the armature rotatably on the yoke; and a joining structure for joining the hinge spring to the yoke in the electromagnetic relay, wherein the hinge spring includes a tongue and a dish-shaped portion; the yoke includes an engaging hole and a fitting portion for engaging with the tongue and the dish-shaped portion, and the hinge spring is joined to the yoke by inserting and fitting the hinge spring into the yoke.

The dish-shaped portion of the hinge spring may include a center hole, and the fitting portion of the yoke may include a recessed part and a raised part corresponding to the center hole of the dish-shaped portion. The recessed part and the raised part of the fitting portion engaged with the hinge spring on the yoke may be formed within a plate thickness of the yoke. The dish-shaped portion may be formed as a circular shape. The tongue of the hinge spring may be formed as a U-shape.

According to the present invention, there is also provided a flux penetration preventing structure for an electromagnetic relay, wherein a coil bobbin is formed, integral with or separate from a base block, and a venting portion for allowing air trapped in a center hole in the coil bobbin to be vented therethrough, is formed in an upper flange of the coil bobbin.

Further, according to the present invention, there is provided an electromagnetic relay comprising an iron core having an iron core head; a coil bobbin for winding a coil around the iron core, formed integral with or separate from, a base block; and a venting portion, for allowing air trapped in a center hole in the coil bobbin to be vented therethrough, formed in an upper flange of the coil bobbin.

The venting portion may comprise at least one groove formed in the upper flange of the coil bobbin in a position where the upper flange contacts the underside of an iron core head. The venting portion may comprise four grooves.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

Before describing the electromagnetic relay and the joining structure of the hinge spring and yoke in the electromagnetic relay according to the present invention, the problem involved in the assembly of the hinge spring and yoke in the prior art electromagnetic relay will be described with reference to FIGS. 1A and 1B.

Figure 1A:
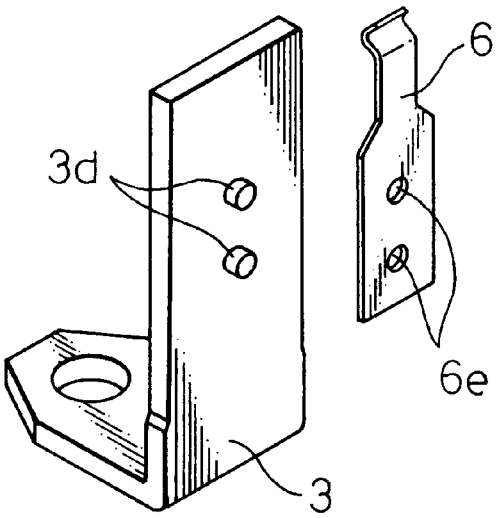
Fig.1A (PRIOR ART)
FIG. 1A is an exploded perspective view for explaining one example of a joining structure of a yoke and a hinge spring in a prior art electromagnetic relay.
Figure 1B:
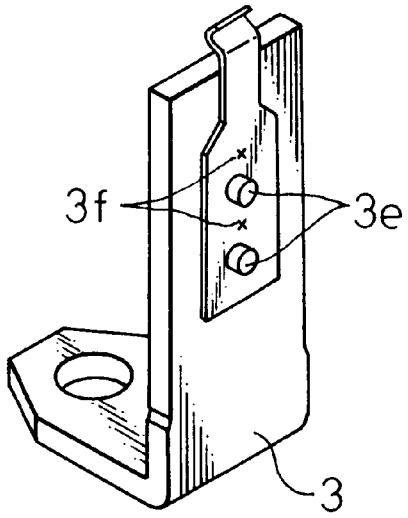
Fig.1B (PRIOR ART)
FIG. 1B is a perspective view of the yoke and hinge spring assembled together in accordance with FIG. 1.

FIG. 1A is an exploded perspective view for explaining one example of the joining structure of the yoke and hinge spring in the prior art electromagnetic relay, and FIG. 1B is a perspective view of the yoke and hinge spring assembled together in accordance with FIG. 1.

Generally, in constructing the electromagnetic relay, a coil is wound around an iron core (1) to construct an electromagnet, and a yoke 3 as a component to complete a magnetic circuit with it is fastened rigidly to the iron core and an armature (2) is rotatably mounted in such a manner as to bridge between the yoke 3 and the head (1*a*) of the iron core of the electromagnet to construct an electromagnet structure. Then, one end of this electromagnet structure is fixed to the yoke 3 and the other end thereof is made to engage with the armature, the rotatable movement of the armature being supported by a plate-like hinge spring 6 formed from a resilient member.

In the prior art electromagnetic relay of this type, the structure shown in FIGS. 1A and 1B, for example, has been employed to secure the hinge spring 6 to the yoke 3; that is, protrusions 3*d* are provided on one surface of the yoke 3, and the protrusions 3*d* on the yoke 3 are inserted into the holes 6*e* opened through the hinge spring 6, after which the protrusions 3*d* on the yoke 3 are deformed by crimping (crimping at crimping portions 3*e*), or the hinge spring 6 is welded directly to the surface of the yoke 3 (welding at welding portions 3*f*), thus joining the hinge spring 6 and yoke 3 in an integral fashion.

However, the yoke/hinge spring joining method of the prior art shown in FIGS. 1A and 1B has had the problem that fixing the hinge spring 6 to the yoke 3 necessarily entails the use of specific assembling equipment (such as a crimping tool or a welder) and the number of assembling steps increases.

In view of the above-described problem with the prior art electromagnetic relay (the yoke/hinge spring assembly structure), according to a first mode of the present invention, a U-shaped tongue is formed on the hinge spring by stamping, and this tongue is passed through an engaging hole opened through the yoke and is made to engage with it; further, a fitting recess having a protrusion thereon is formed in the yoke, and a hole opened through the hinge spring is fitted onto the protrusion, thereby fixing the hinge spring to the yoke.

Figure 2:
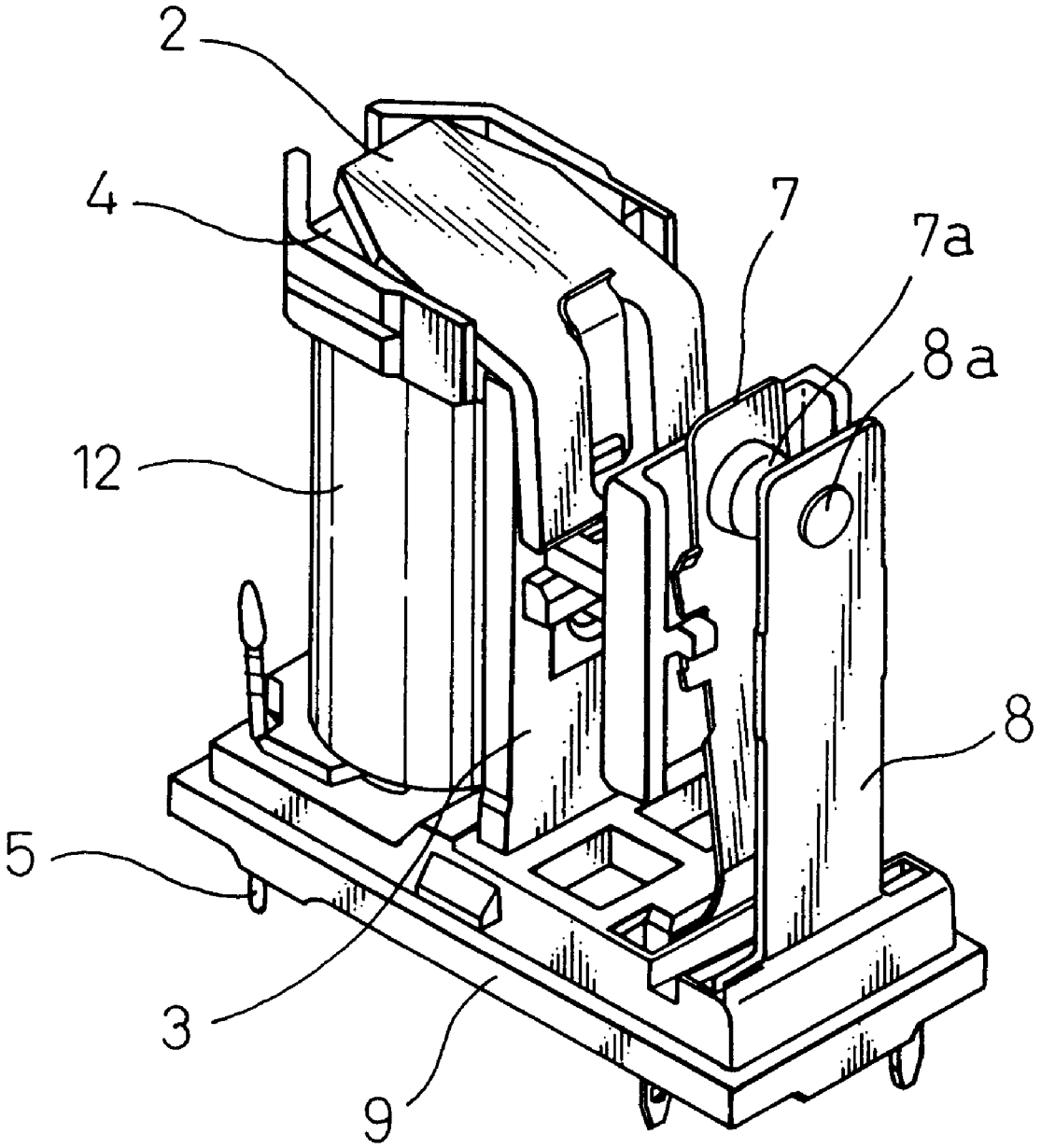
FIG. 2 is a perspective view showing the entire construction of an electromagnetic relay according to the present invention.
Figure 3:
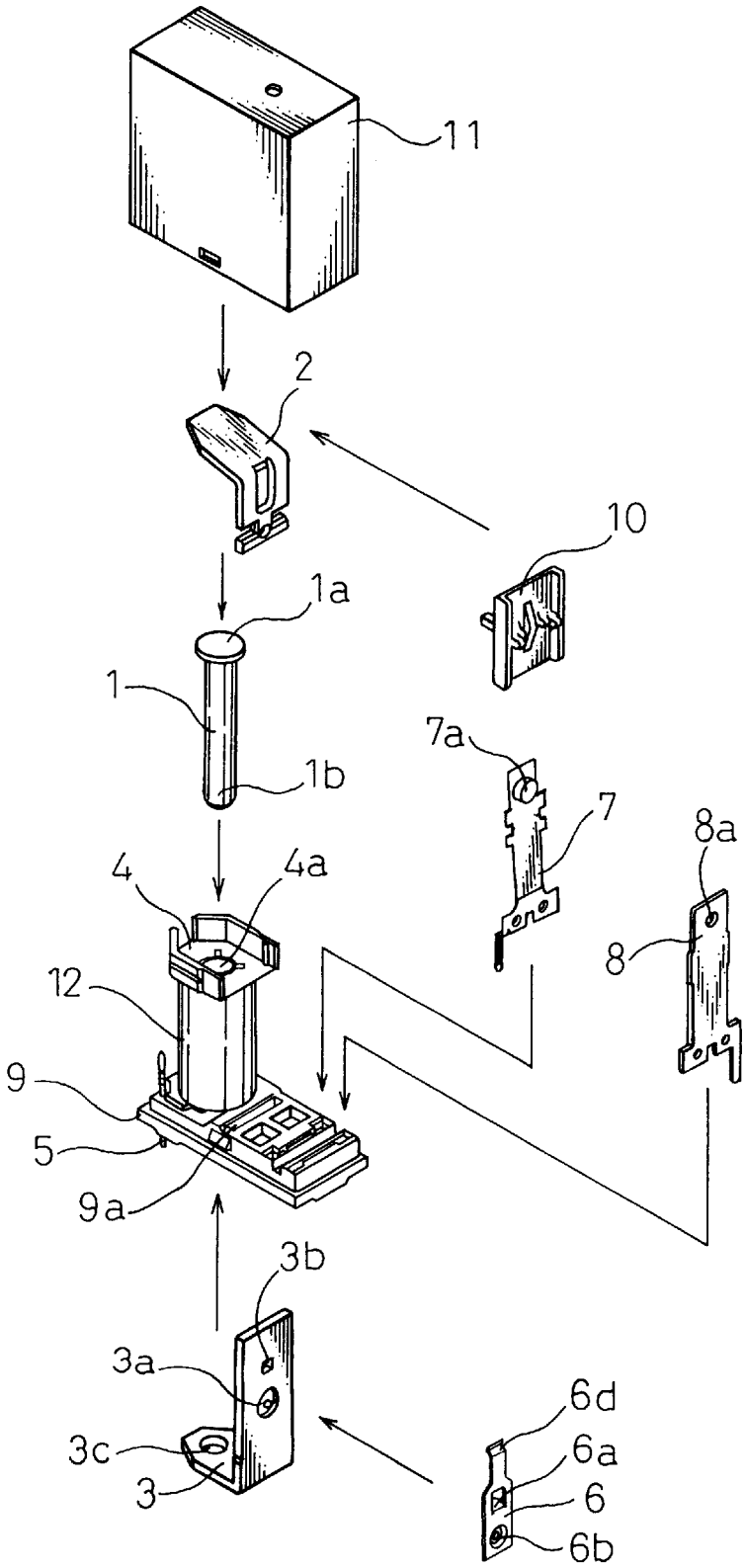
FIG. 3 is an exploded perspective view showing the entire construction of the electromagnetic relay of the present invention.

FIG. 2 is a perspective view showing the entire construction of the electromagnetic relay according to the present invention, and FIG. 3 is an exploded perspective view showing the entire construction of the electromagnetic relay of the present invention. In FIGS. 2 and 3, reference numeral 1 is an iron core, 2 is an armature, 3 is a yoke, 4 is a coil bobbin, 5 is a coil terminal, 6 is a hinge spring, 9 is a base block, 10 is a card, and 12 is a coil. Further, reference numeral 7 is a movable contact spring, 7*a* is a movable contact, 8 is a stationary contact spring, 8*a* is a stationary contact, and 11 is a case.

As shown in FIG. 3, in the assembly process of the electromagnetic relay, the coil bobbin 4 is placed on the base block 9 made of an insulating material, and the coil 12 is wound around the coil bobbin 4. Further, the iron core 1 is inserted through a center hole 4*a* in the coil bobbin 4 until the lower end portion lb of the iron core 1 reaches the bottom of the base block 9. After that, the L-shaped yoke 3 is inserted through a hole 9*a* in the base block 9 from the underside thereof, and a hole 3*c* opened through the yoke 2 is fitted onto the lower end portion lb of the iron core 1 to fix the yoke 3 to the base block 9, so that an electromagnet is constructed.

Here, the coil bobbin 4 may be formed integrally with the base block 9 beforehand or may be fabricated as a separate coil component.

Thereafter, the hinge spring 6 is assembled to the yoke 6; alternatively, the yoke 6 may be fitted with the hinge spring 6 beforehand. Next, the movable contact spring 7 and the stationary contact spring 8 are inserted in the base block 9 and secured in place, after which the armature 2 is engaged with the free end 6*d* of the hinge spring 6 so that the armature 2 is held opposite the head la of the iron core. Further, the card 10 is fitted in position by engaging it onto the armature 2 and the movable contact spring 7.

Here, the coil terminals 5 may be attached beforehand by inserting them in the base block 9 during the process of molding the latter. Finally, the case 11 is mounted to complete the assembly of the electromagnetic relay.

Figure 4A:
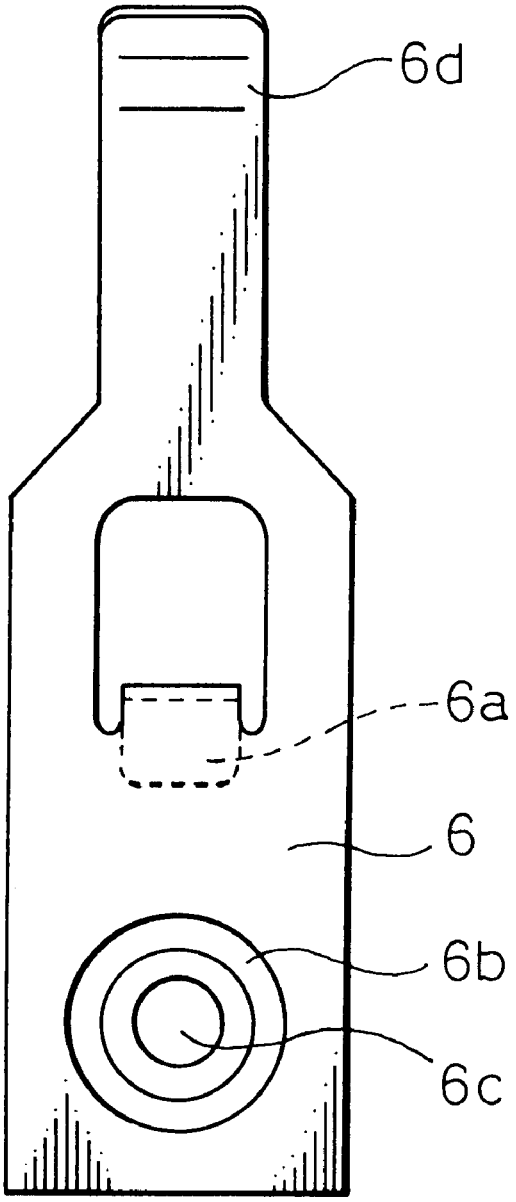
FIG. 4A is an enlarged front view of one example of the hinge spring for explaining a first mode of the present invention.
Figure 4B:
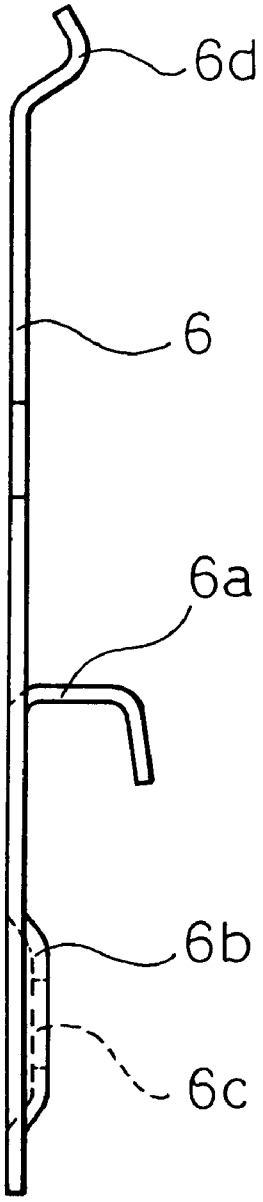
FIG. 4B is a side view of the hinge spring shown in FIG. 4A.

FIG. 4A is an enlarged front view of one example of the hinge spring for explaining the first mode of the present invention, and FIG. 4B is a side view of the hinge spring shown in FIG. 4A. In FIGS. 4A and 4B, reference numeral 3*a* is the fitting recess formed in the yoke, 3*b* is the engaging hole formed in the yoke, 3*d* is the protrusion formed on the yoke, 6*a* is the tongue provided on the hinge spring, 6*b* is the dish-shaped portion formed on the hinge spring, and 6*c* is a hole (center hole) of the dish-shaped portion 6*b* opened through the hinge spring 6.

The structure (joining structure) of the yoke 3 and hinge spring 6, the essential components of the first mode of the present invention, will be described with reference to FIGS. 4A and 4B.

As shown in FIGS. 4A and 4B, the hinge spring 6 is formed from a plate-like resilient member, and the dish-shaped portion 6*b*, formed by extrusion with a press into such a shape as to bulge around the outer periphery thereof, is provided in the lower end portion of the hinge spring 6. Further, the hole 6*c* is opened through the center of the dish-shaped portion 6*b*. On the hinge spring 6 is also formed the U-shaped tongue 6*a* by cutting and bending a portion upward of the portion where the dish-shaped portion 6*b* is formed. The free end 6*d* of the hinge spring 6 is bent in a dogleg shape in such a manner as to protrude in the same direction as the bulging direction of the dish-shaped portion 6*b* and to engage with the armature 2.

Figure 5A:
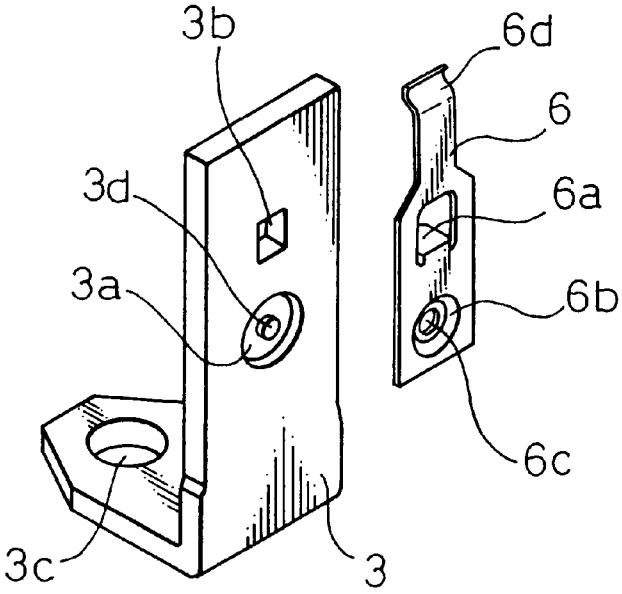
FIG. 5A is an exploded perspective view showing one example of the joining structure of the yoke and hinge spring according to one embodiment of the first mode of the present invention.
Figure 5B:
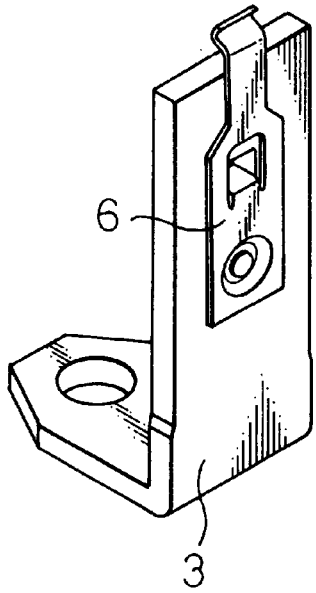
FIG. 5B is a perspective view of the yoke and hinge spring assembled together in accordance with FIG. 5A.

FIG. 5A is an exploded perspective view showing one example of the joining structure of the yoke and hinge spring according to one embodiment of the first mode of the present invention, and FIG. 5B is a perspective view of the yoke and hinge spring assembled together in accordance with FIG. 5A.

As shown in FIGS. 5A and 5B, the yoke 3 to which the hinge spring 6 is joined is provided with the fitting recess 3*a* into which the dish-shaped portion 6*b* of the hinge spring 6 is fitted and with the engaging hole 3*b* in which the U-shaped tongue 6*a* of the hinge spring 6 engages. That is, the U-shaped tongue 6*a* provided on the hinge spring 6 is made to engage with the engaging hole 3*a* formed in the yoke, and the dish-shaped portion 6*b* provided on the hinge spring 6 is made to fit into the fitting recess 3*a* formed in the yoke 3. Here, the protrusion 3*d* provided on the yoke 3 is made to pass through the hole 6*c* opened in the center of the dish-shaped portion 6*d* of the hinge spring 6.

In this way, according to the embodiment of the first mode of the present invention, the U-shaped tongue 6*a* is formed on the hinge spring 6 by stamping, and this tongue 6*a* is passed through the engaging hole 3*b* formed in the yoke 3 and is made to engage with it; further, the dish-shaped portion 6*b* provided on the hinge spring 6 is fitted into the fitting recess formed in the yoke 3, with the protrusion 3*d* provided on the yoke 3 being fitted into center hole 6*c* of the dish-shaped portion 6*d* of the hinge spring 6, to join the hinge spring 6 to the yoke 3.

The dish-shaped portion 6*b* of the hinge spring 6 and its mating fitting recess 3*a* of the yoke 3 and the hole 6*c* of the hinge spring 6 and its mating protrusion of the yoke 3 need not necessarily be formed circular in shape, but it will be appreciated that these can be formed in various other shapes (for example, rectangular).

As is apparent from the above description, according to the first mode of the present invention, the assembling of the hinge spring to the yoke in the electromagnetic relay is accomplished by a simple part-to-part joining structure that does not require specific assembling equipment. This structure serves to simplify the assembly process and drastically reduce the number of assembling steps required.

Next, the flux penetration preventing structure for the electromagnetic relay will be described as a second mode of the present invention, but before that, the prior art and the problem associated with the prior art will be described with reference to FIGS. 6A and 6B.

As previously described with reference to FIGS. 2 and 3, in constructing the electromagnet of the electromagnetic relay, for example, the coil 12 is wound around the coil bobbin 4, the iron core 1 is inserted through the center hole 4*a* in the coil bobbin 4, and the yoke 3, as a component to form a magnetic circuit, is fixed to the iron core 1. Further, the armature 2 is mounted in such a manner as to bridge between the head la of the iron core and the other end of the yoke 3, and the armature 2 is rotatably held on the plate-like hinge spring 6 formed from a resilient member, to construct the electromagnet structure.

In operation of the electromagnetic relay, when the coil 12 is energized by passing a current through the coil 12, the armature 2 is attracted to the head la of the iron core 1, which in turn moves the movable contact spring 7 via the card 10, causing the movable contact 7*a* to come into contact with the stationary contact 8*a*.

When mounting the electromagnetic relay on a printed circuit board, usually the printed circuit board is passed through a high-temperature solder bath, and the electromagnetic relay with a solder applied to the externally extending terminal leads thereof is mounted rigidly on the printed circuit board. At this time, there is a possibility that flux may rise from the solder bath and penetrate into the interior of the electromagnetic relay. If the flux from the solder bath penetrates into the interior of the electromagnetic relay, the solder may be deposited on the contacts, which can cause contact failures.

Figure 6A:
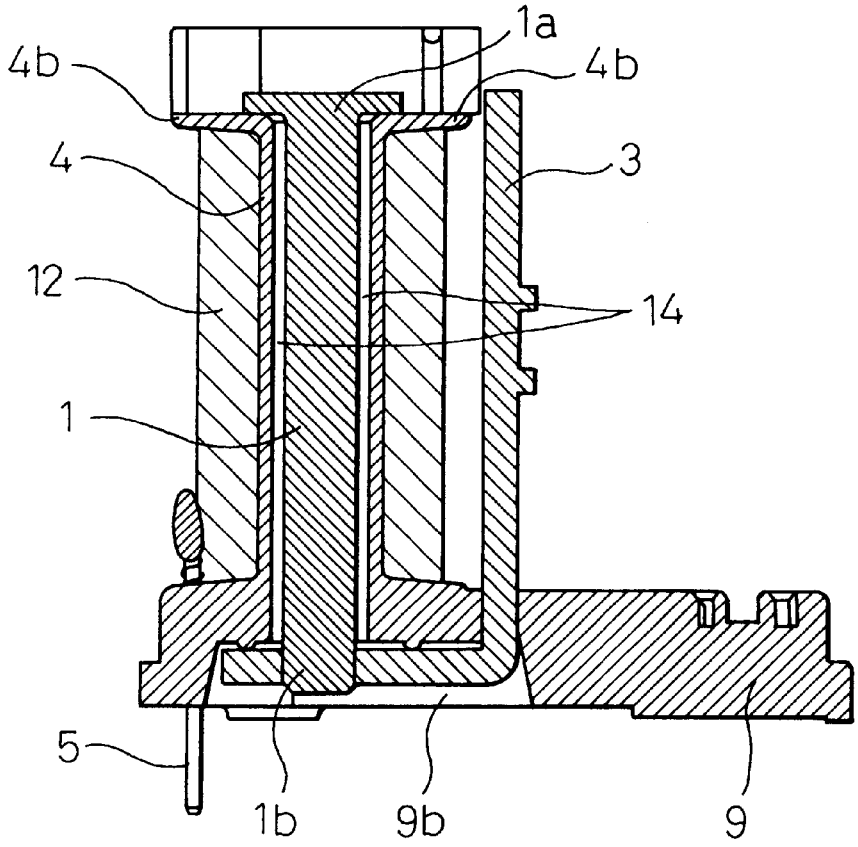
Fig.6A (PRIOR ART)
FIG. 6A is a front cross-sectional view showing one example of an electromagnet structure in the prior art electromagnetic relay.
Figure 6B:
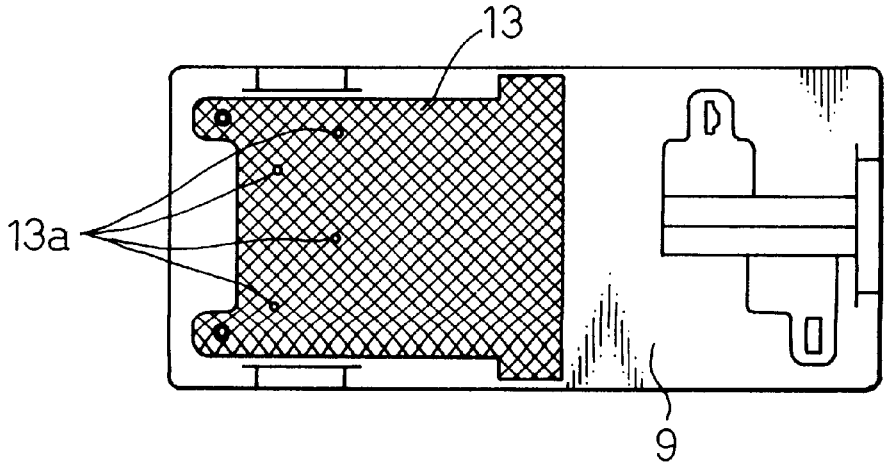
Fig.6B (PRIOR ART)
FIG. 6B is a bottom view of the electromagnet shown in FIG. 6A.

To prevent the flux from rising from the solder bath and penetrating into the interior of the electromagnetic relay, it has traditionally been practiced to seal the externally extending terminal side (for example, coil terminals 5) of the base block 9, that is, the bottom side of the electromagnetic relay (a bottom sealing portion 9*b*), as shown in FIGS. 6A and 6B).

When constructing the electromagnetic relay having the bottom sealing portion 9*b*, not only the terminal leads (5) but also the lower end portion 1*b* of the iron core 1 and the portion of the L-shaped yoke 3 exposed in the bottom sealing portion 9*b* must be embedded in the sealing. To seal these portions, the electromagnetic relay is turned upside down with the bottom of the coil block 9 facing up, for example, and a liquid sealant 13 is filled into the exposed area to seal the bottom sealing portion 9*b* of the base block 9. In one known means, this is accomplished by applying the liquid sealant 13 to the exposed area and by curing the sealant by heating. After the sealing, the case 11 is mounted onto the electromagnetic relay structure and fitted into the fitting portion of the base block 9 to secure it in position.

In the above securing means, since the head la of the iron core 1 is placed in intimate contact with the upper flange 4*b* of the coil bobbin 4, a gap 14 is formed between the outer circumferential surface of the iron core 1 and the inner circumferential surface of the coil bobbin 4. As a result, when the liquid sealant 13 is filled into the bottom of the base block 9 and heated, the air trapped in the gap 14 expands by heat and air bubbles are formed when the liquid sealant 13 cures after heating. This structure, therefore, has had the problem that pinholes 13*a* due to the bubbles are formed in the bottom sealing portion 9*b* (liquid sealant 13), defeating the purpose of the sealing structure.

In view of the above-described problem with the prior art electromagnetic relay (the electromagnetic relay having a flux penetration preventing structure), according to the second mode of the present invention, venting grooves are formed in the flange of the coil bobbin so that, when the liquid sealant is cured by heating, if the air trapped in the gap between the outer circumferential surface of the iron core and the inner circumferential surface of the coil bobbin expands, the air is vented through the venting grooves to the exterior of the construction, thus facilitating the sealing.

Figure 7A:
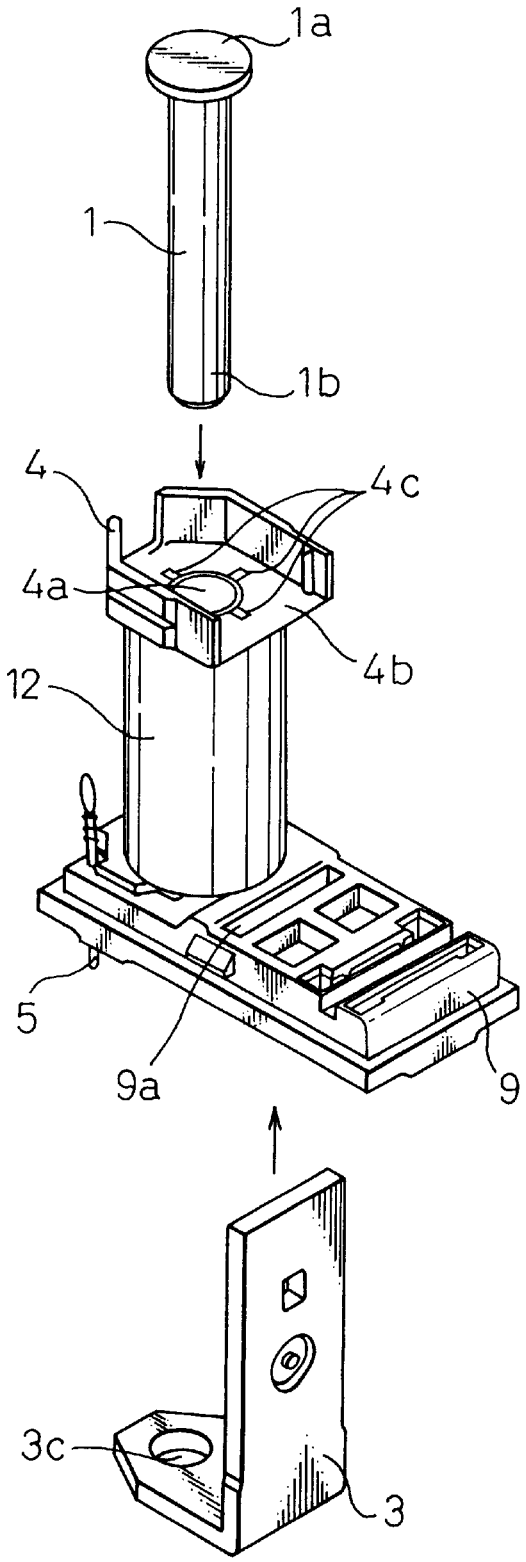
FIG. 7A is an exploded perspective view showing one example of the electromagnet according to one embodiment of a second mode of the present invention.
Figure 7B:
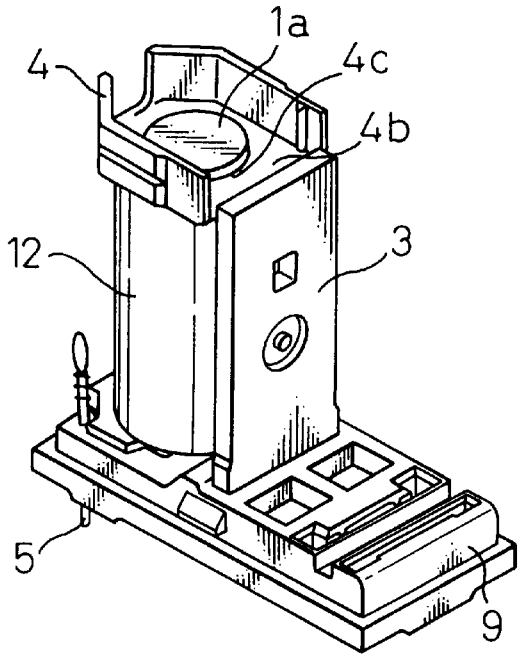
FIG. 7B is a perspective view showing the electromagnet of FIG. 7A in an assembled condition.

FIG. 7A is an exploded perspective view showing one example of the electromagnet according to one embodiment of the second mode of the present invention, and FIG. 7B is a perspective view showing the electromagnet of FIG. 7A in an assembled condition. Further, FIG. 8A is a front sectional view of the electromagnet shown in FIG. 7B, and FIG. 8B is a bottom view of the electromagnet shown in FIG. 8A.

In FIGS. 7A, 7B, 8A, and 8B, reference numeral 4 indicates the coil bobbin, 4*a* the center hole opened through the coil bobbin, 4*b* the flange of the coil bobbin, and 4*c* the venting holes of the coil bobbin. The general assembly process of the electromagnetic relay is the same as that described with reference to FIG. 3, and a description thereof will not be repeated here.

The iron core 1 and yoke 3, the essential components of the second mode of the present invention, as well as the structure of the base block 9 and the sealing structure of the electromagnetic relay, will be described in detail below.

Figure 8A:
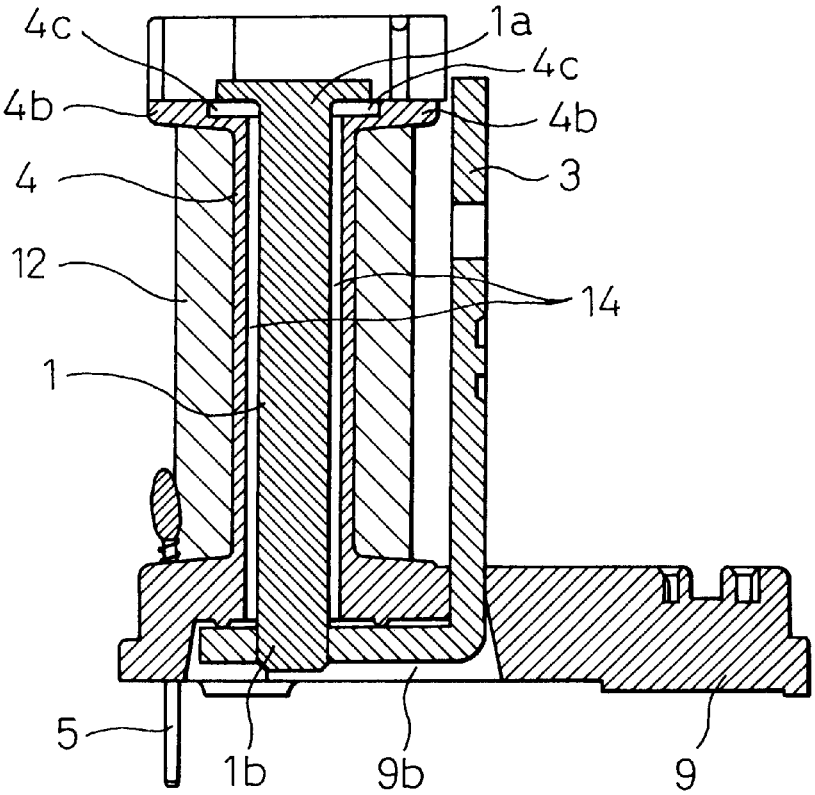
FIG. 8A is a front sectional view of the electromagnet shown in FIG. 7B.
Figure 8B:
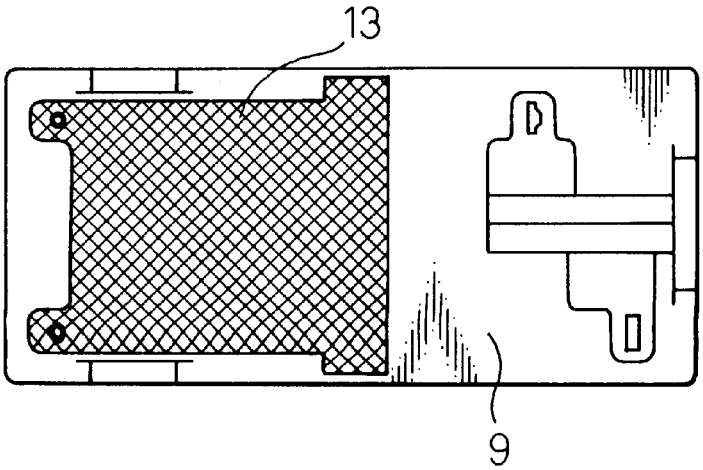
FIG. 8B is a bottom view of the electromagnet shown in FIG. 8A.

As can be seen from FIGS. 7A and 8A, the base block 9 is provided with the venting grooves 4*c* formed in the upper flange 4*b* of the coil bobbin 4. These venting grooves 4*c* are formed, for example, by molding. The head la of the iron core 1 is held firmly on the flange 4*b* where the venting grooves 4*c* are formed, with the underside of the head la in intimate contact with the flange 4*b*.

The outside edges of the venting grooves 4*c* are made outside than the outside diameter of the head la of the iron core, that is, the venting grooves 4*c* are formed to extend outward of the head la of the iron core so that, if the air trapped in the gap 14 between the outer circumferential surface of the iron core 1 and the inner circumferential surface of the coil bobbin 4 expands by heating, the air can be vented outside the coil bobbin 4 through the venting grooves 4*c*. That is, during assembly, the iron core 1 is fitted in position with gaps provided between the head la of the iron core 1 and the venting grooves 9c provided in the base block 9 (the flange 4*b* of the coil bobbin 4), as shown in FIG. 8A.

This structure serves to prevent pinholes 13*a* from being formed in the bottom sealing portion 9*b* (liquid sealant 13) due to air bubbles when the liquid sealant 14 filled into the bottom of the base block 9 is heated.

In this way, according to the second mode of the present invention, the coil bobbin 4 formed integrally with the base block 9, or fabricated as a separate component and mounted on the base block 9, is provided with venting grooves 4*c* in the flange 4*b* thereof at the inlet of the center hole 4*a* so that a gap is formed between the head la of the iron core 1 and the flange 4*b* of the coil bobbin 4 when the lower end portion 1*b* of the iron core 1 is fitted rigidly into the hole 3*c* in the yoke 3 in such a manner as to clamp the coil bobbin 4 in a sandwich fashion; in this structure, the lower end portion 1*b* of the iron core 1 and the portion around the hole 3*c* of the yoke 3 exposed in the bottom sealing portion 9*b* of the base block 9 are sealed with the liquid sealant 13. That is, when curing the liquid sealant 13 by heating, if the air trapped in the gap 14 between the outer circumferential surface of the iron core 1 and the inner circumferential surface of the coil bobbin 4 expands, the air can be vented outside through the venting grooves 4*c* formed in the flange 4*b* of the coil bobbin 4. This structure facilitates sealing work.

As described in detail above, according to the first mode of the present invention, the assembling of the hinge spring to the yoke in the electromagnetic relay is accomplished by a simple part-to-part joining structure that does not require specific assembling equipment; this structure serves to simplify the assembly process and drastically reduce the number of assembling steps. Further, according to the second mode of the present invention, work efficiency can be enhanced by smoothly performing sealing work and providing pinhole-free sealing to the bottom sealing portion of the base block of the electromagnetic relay.

Many different embodiments of the present invention may be constructed without departing from the spirit and scope of the present invention, and it should be understood that the present invention is not limited to the specific embodiments described in this specification, except as defined in the appended claims.

What is claimed is:

1. A flux penetration preventing structure for an electromagnetic relay having at least one electric controllable contact, comprising:

a coil bobbin, integral with or separate from a base block, having a venting portion, for allowing air trapped in a center hole in said coil bobbin to be vented therethrough; and a core, fixed within the center hole in said coil bobbin in a non-moveable manner, extending through the entire length of the center hole, wherein said venting portion includes at least one groove formed in an upper flange of said coil bobbin in a position where said upper flange contacts the underside of an iron core head of said core, and the groove of said upper flange extends outward of said iron core head.

2. A flux penetration preventing structure for an electromagnetic relay, as claimed in claim 1, wherein said venting portion comprises four grooves.

3. An electromagnetic relay comprising:

an iron core having an iron core head;

a coil bobbin, for winding a coil around said iron core, formed integral with or separate from, a base block;

at least one electric contact controlled by said coil; and a venting portion, for allowing air trapped in a center hole in said coil bobbin to be vented therethrough, said venting portion including at least one groove formed in an upper flange of said coil bobbin in a position where said upper flange contacts the underside of an iron core head of said core, and the groove of said upper flange extends outward of said iron core head;

wherein said iron core is fixed in the center hole of said coil bobbin in a non-movable manner, extending through the entire length of the center hole.

4. An electromagnetic relay, as claimed in claim 3, wherein said venting portion comprises four grooves.

* * * * *